United States Patent [19]

Ohba et al.

[11] Patent Number: 4,519,523

[45] Date of Patent: May 28, 1985

[54] SHEET PACKET DISCHARGING APPARATUS

[75] Inventors: Hiroshi Ohba; Shigeo Horino, both of Tokyo, Japan

[73] Assignee: Tokyo Shibaura Denki Kabushiki Kaisha, Kawasaki, Japan

[21] Appl. No.: 411,960

[22] Filed: Aug. 26, 1982

[30] Foreign Application Priority Data

Aug. 28, 1981 [JP] Japan ..... 56-135047

[51] Int. Cl.[3] ..... B65G 59/06

[52] U.S. Cl. ..... 221/129; 221/253

[58] Field of Search ..... 221/225, 253, 259, 270, 221/227, 237, 238, 129; 414/114; 209/534; 198/447, 482; 194/10, DIG. 26

[56] References Cited

U.S. PATENT DOCUMENTS

| | | | |
|---|---|---|---|
| 3,414,126 | 12/1968 | Vulcano | 221/253 X |
| 3,777,932 | 12/1973 | Matsui et al. | 221/253 |
| 4,000,821 | 1/1977 | Naito et al. | 221/253 |
| 4,273,234 | 6/1981 | Bourgeois | 198/482 X |
| 4,339,221 | 7/1982 | Mitzel et al. | 414/114 |

FOREIGN PATENT DOCUMENTS

| | | |
|---|---|---|
| 37989 | 10/1981 | France . |
| 55-48212 | 3/1980 | Japan . |
| 899068 | 6/1962 | United Kingdom . |
| 1482031 | 8/1977 | United Kingdom . |
| 2106880 | 4/1983 | United Kingdom . |

*Primary Examiner*—Stanley H. Tollberg

*Attorney, Agent, or Firm*—Cushman, Darby & Cushman

[57] ABSTRACT

A bill packet discharging apparatus, which comprises a plurality of bill packet accommodating cases accommodating respective different denomination bill packet stacks and a bill packet feed-out mechanism for feeding out the lowermost bill packet in a given bill packet accommodating case through an outlet provided at the lower end of the case. The bill packet fed out from the case by the feed-out mechanism is conveyed upwards by an elevator mechanism and then led to a bill packet discharging outlet provided adjacent to the top of the apparatus.

5 Claims, 11 Drawing Figures

SHEET PACKET DISCHARGING APPARATUS

BACKGROUND OF THE INVENTION

This invention relates to an automatic sheet packet discharging apparatus and, more particularly, to an automatic bill packet discharging apparatus in an automatic money discharging system.

In the prior art bill packet discharging apparatus, a number of bill packets are accommodated in stacks in bill packet boxes for different denominations. Each of the bill packet boxes is provided with a locking mechanism. When an instruction to discharge bill packets of a given denomination is given by an operator, from a keyboard to the discharging apparatus, the locking mechanism of the bill packet box accommodating bill packets of the given denomination is released. The operator can now take out a necessary number of bill packets from the released bill packet box. When taking out bill packets from this bill packet discharging apparatus, it is likely that a band around a bill packet will be caught by an edge of the bill packet box or a partition wall so that the bills will become loose. This is undesirable from the standpoint of the smooth operation of removing the bill packets.

SUMMARY OF THE INVENTION

An object of the invention is to provide a sheet packet discharging apparatus which can automatically feed out sheet packets succession from a sheet packet box and convey them to a discharging outlet.

According to the invention, a plurality of sheet boxes are provided, in which numbers of sheet packets of different kinds are accommodated as stacks. Each sheet packet box is provided with a sheet packet feeder. The sheet packet box has an outlet formed in the lowest portion of one side wall. The sheet packet feeder pushes out the lowermost sheet packet in the stack through the outlet. At this time, the sheet packet is fed out in the direction parallel to the band of the sheet packet. The sheet packet fed out by the sheet packet feeder is transported upwards by an elevator device to be brought to a discharging outlet provided above the sheet packet boxes.

The sheet packet feeder includes a conveyor movable in the direction parallel to the band. The conveyor has a first portion having a protuberance section which projects from a surface and a second portion with no protuberance section. The conveyor cooperates with the outlet of the packet box so that the protuberance section keep the packets in the packet box and the second portion allows one packet to be released. The leading part of the protuberance section pushes the packet in the second portion out of the packet box.

DETAILED DESCRIPTION OF THE PREFERRED EMBODIMENT

Figure 1:
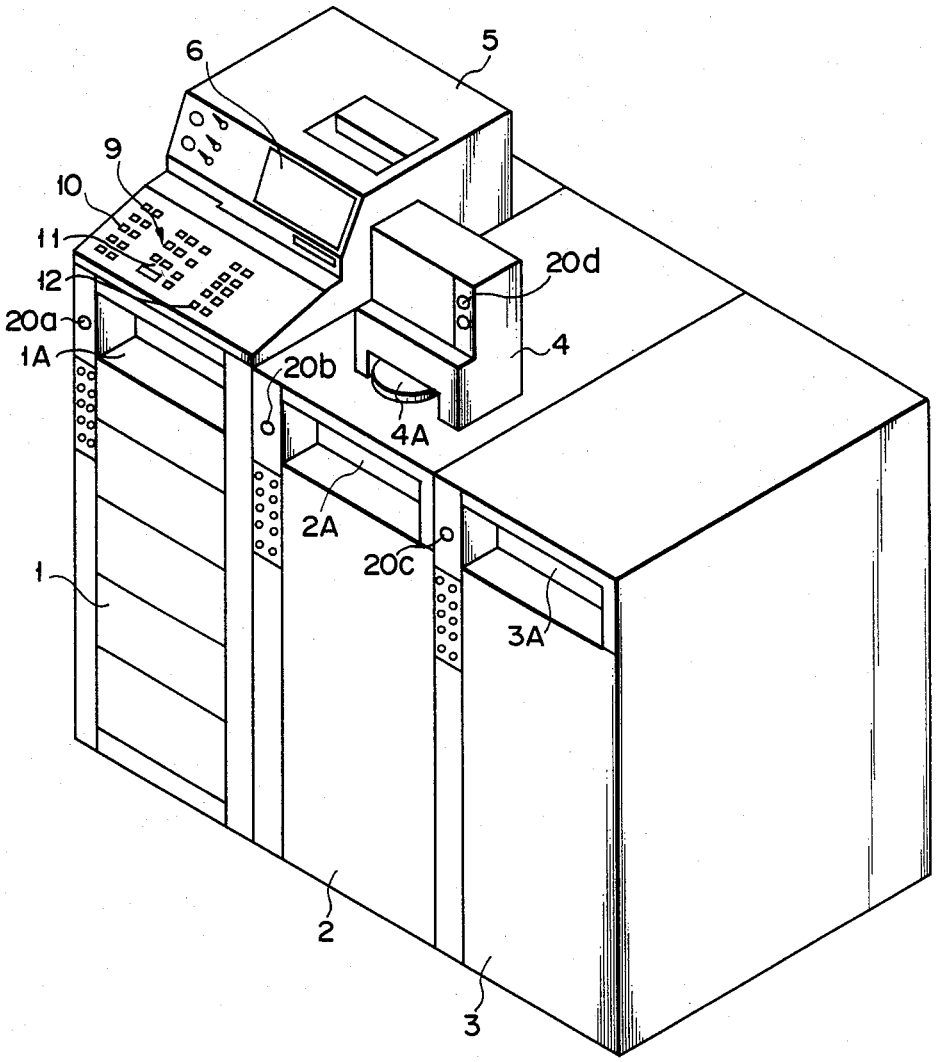
FIG. 1 is a perspective view showing an automatic money discharging system provided with a sheet packet discharging apparatus according to the invention.

FIG. 1 shows an automatic money discharging system. The system comprises a sheet (bill) discharging apparatus 1, a sheet (bill) packet discharging apparatus 2 for discharging sheet (bill) packets (each having a certain number of sheet i.e. bills), a coin roll discharging apparatus 3 for discharging coin rolls (each having a certain number of coins), a coin discharging apparatus 4, and an operating section 5 including a control system. In the individual discharging apparatus, the bill discharging apparatus 1, bill packet discharging apparatus 2, and coin roll discharging apparatus 3 are secured to one another side by side in the above order. The coin discharging apparatus 4 is provided on top of this lateral assembly (more particularly on top of the bill packet discharging apparatus 2). The individual discharging apparatus 1 to 4 are provided with discharging outlets 1A, 2A and 3A and a coin saucer 4A respectively. The coin saucer 4A is disposed at the bottom of the coin discharging apparatus 4, while the discharging outlets 1A, 2A and 3A of the other apparatus are provided at the top of the front. The operating section 5 is provided at the front with a display section 6 and also with an operation panel 10, which has a group 10 of command keys for providing such instructions as obtaining a sum total, effecting payment, etc., a group 11 of numeral keys for keying amount data, and a group 12 of denomination specifying keys for specifying the denomination. The individual discharging apparatuses are provided at the front with respective discharge indication lamps 20*a* to 20*d* for indicating the discharge of money.

Figure 2:
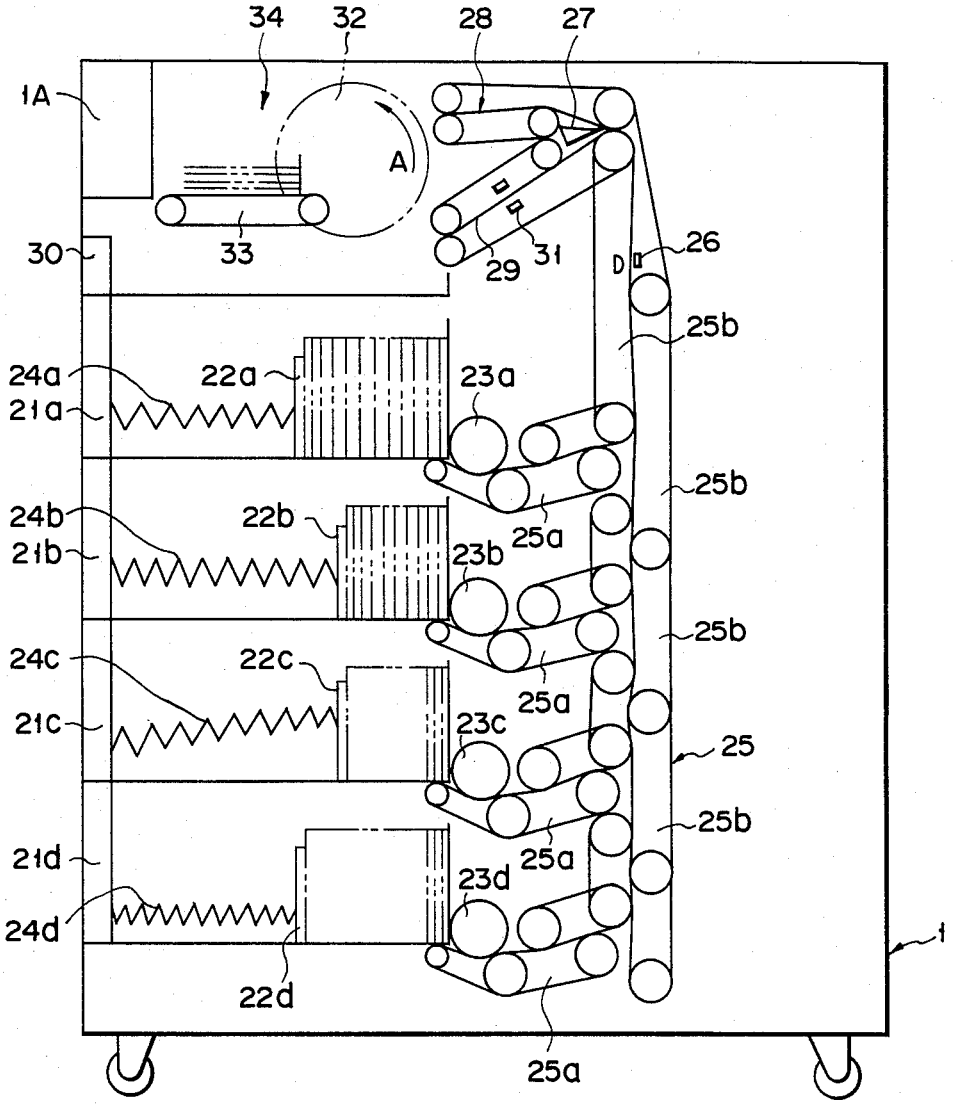
FIG. 2 is a schematic view showing the internal construction of the sheet packet discharging apparatus shown in FIG. 1.

The bill discharging apparatus 1 has a construction as shown in FIG. 2. The apparatus 1 includes a plurality (namely four in this embodiment) of bill accommodating sections 21*a* to 21*d* which are disposed one above another. Bills of different denominations are accommodated in these bill accommodating sections 21*a* to 21*d*. Bills in each bill accommodating section can be taken out one by one and conveyed upwards by a conveyor unit 25. Bills that have been conveyed by the conveyor unit 25 are transferred to a discharging mechanism 34 to be led to the discharging outlet 1A. In the individual bill accommodating sections 21*a* to 21*d*, bills of different denominations are stacked in the lateral direction. The stacks of bills are urged against the back wall of the respective bill accommodating sections by respective back-up plates 22*a* to 22*d* spring biased by springs 24*a* to 24*d*. The bill accommodating sections 21*a* to 21*d* are provided in a lower portion of the back wall with respective bill outlets (not shown). At the bill outlets, bill take-out rollers 23*a* to 23*d* are provided such that the respective bill stacks are urged against them. The conveyor unit 25 is constructed by endless belt conveyors. It includes lateral conveyors 25*a* coupled to the respective bill take-out rollers 23*a* to 23*d*, vertical conveyors 25*b* for vertically conveying bills transferred from the lateral conveyors, a bill discharging conveyor 28 for conveying bills transferred from the vertical conveyor 25*b* to a bill discharging mechanism, and a reject conveyor 29 for taking rejected bills to a rejected bill collector 30. A sorting gate 27 is provided at a point, which constitutes the start end of the route of the bill discharging conveyor 28 and the start end of the route of the reject conveyor 29. The operation of the sorting gate 27 is controlled by a control signal from the operating section 5. The bills having been transported to the gate 27 are sorted and led to either of the two routes.

The bill discharging mechanism 34 includes a vane wheel 32, which is rotated to receive bills from the bill discharging conveyor 28 and stack the received bills on a second bill discharging conveyor 33. At this time, the bills are stacked with their sort side directed toward the front. The stacked bills are conveyed by the second discharging conveyor 33 to the discharging outlet 1A. A superposed bill detector 26 is provided on the uppermost vertical conveyor 25*b* of the conveyor unit 25, and a rejection number detector 31 is provided on the reject conveyor 29. These detectors each are composed of a photoemissive element and a photoelectric element, these elements facing each other.

Assume now a case where an instruction for discharging five bills from the uppermost bill accommodating section 21*a* is provided from the operating section 5. In this case, the take-out roller 23*a* is rotated five rotations according to a control signal from the operating section 5. With each rotation, a bill is taken out and conveyed by the lateral conveyor 25*a* and vertical conveyor 25*b* to the tip of the sorting gate 27. As each bill passes through the superposed bill detector 26 during the transport, it determines whether or not there are any superposed bills. If no superposed bill is detected, the bill is led to the bill discharging conveyor 28 by the gate 27. If superposed bills are detected, they are led to the reject conveyor 29 by the gate 27. Thus, non-superposed bills are conveyed to the bill discharging mechanism 34, while superposed bills are conveyed to the rejected bill collector 30. As rejected bills are conveyed on the reject conveyor 29, they are detected by the rejection number detector 31. The number of rejections detected is coupled to the control system in the operating section 5 to be described later. In the control system, the amount of bills corresponding to the number of rejections is calculated as deficit. To make up for the deficit, the take-out roller 23*a* is rotated a required number of rotations. Consequently, bills corresponding in number to the number specified by the operating section 5 (in this example, five bills) are discharged from the discharging outlet 1A. The bills that have been conveyed one by one by the first bill discharging conveyor 28 are stacked after reversal with the counterclockwise rotation of the vane wheel 32 (i.e., in the direction of arrow A) on the second bill discharging conveyor. When the stacking of the specified number of bills (i.e., five) has been completed, the second bill discharging conveyor 33 is driven according to a control signal from the operating section 5, whereby the five stacked bills are discharged to the discharging outlet 1A.

Figure 3:
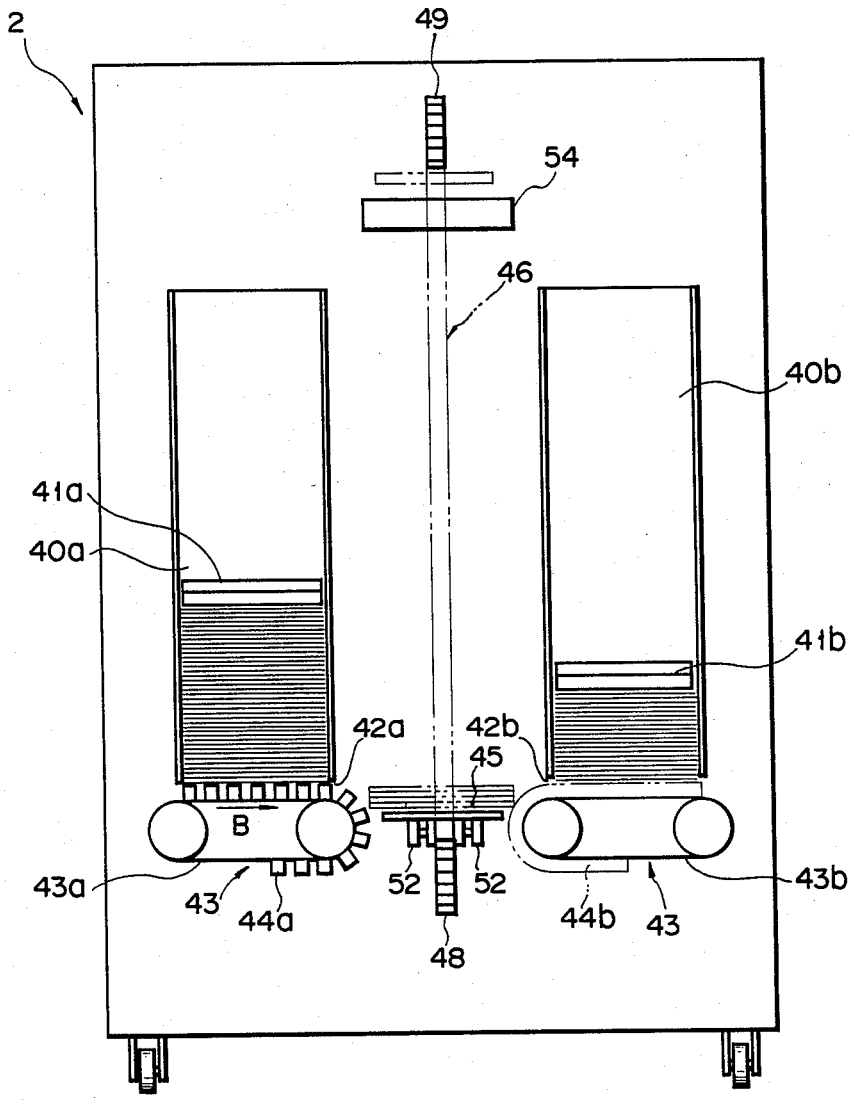
FIG. 3 is a front view showing the internal construction of the sheet packet discharging apparatus according to the invention.
Figure 4:
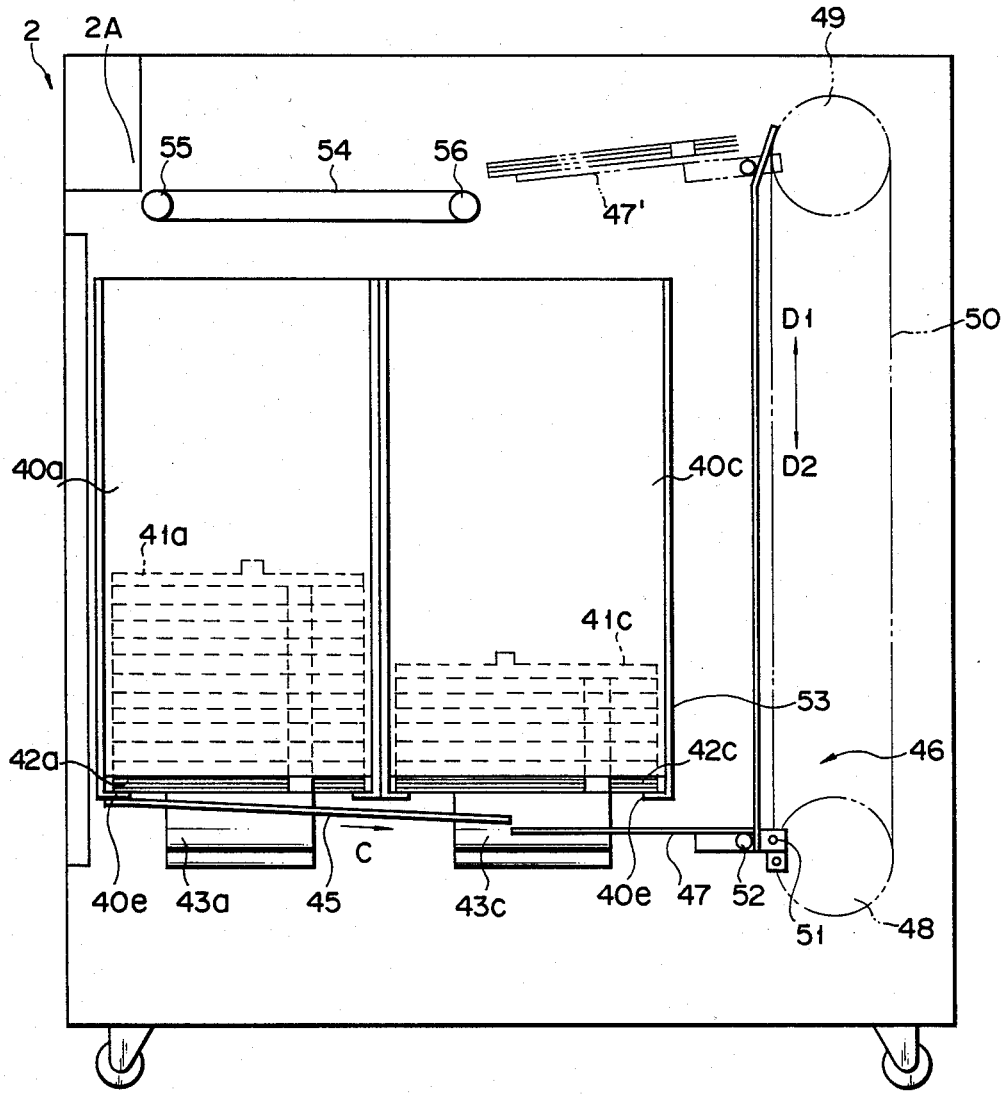
FIG. 4 is a side view showing the internal construction of the sheet packet discharging apparatus shown in FIG. 3.

The bill packet discharging apparatus 2 has a construction as shown in front view in FIG. 3 and in side view in FIG. 4. The apparatus 2 includes a plurality (namely four in this embodiment) of bill packet accommodating sections 40*a* to 40*d* (two adjacent sections being shown in the Figures). A bill packet take-out mechanism 43 is disposed under each bill packet accommodating section. An elevator mechanism 46 is provided to raise or upwardly convey a fed-out bill packet. A bill packet discharging conveyor 54 is provided to receive the upwardly conveyed bill packet and lead it to the bill packet discharging outlet 2A. Each bill packet accommodating section has a rectangular shape open at the top and bottom. A pair of end supporting members 40*e*, not shown in FIG. 3, are provided at the lower end of the section along the opposite ends to support the ends, i.e., short sides, of the lowermost bill packet. Bill packets of different denominations, each bound by a band, are stacked in the respective bill packet accommodating sections 40*a* to 40*d*. The opposite ends of the lower surface of the stack of bill packets are supported by the pair end supporting members. Top plates 41*a* to 41*d* are placed on the respective stacks to prevent flaring of the end portions of the stacks. In the bill packet accommodating sections 40*a* to 40*d*, respective slits 42*a* to 42*d* are provided in the opposite side walls adjacent to the lower end thereof. The lowermost bill packet in the stack can be forced out through the slit. The gap of the slits 42*a* to 42*d*, i.e., the dimension from the upper edge of the slit to the end supporting members 40*e*, is set to be greater than the thickness of one bill packet but less than the thickness of two bill packets. In FIG. 3, which is a front view, the short side of bill packets is shown, while in FIG. 4, which is a side view, the long side of bill packets is shown. Bill packets are accommodated in this state in the bill packet accommodating sections 40*a* to 40*d*. Two adjacent bill packet accommodating sections, when viewed from the front, are spaced apart a distance. Adjacent bill packet accommodating sections in the side direction of the apparatus are disposed close to each other. The bill packet take-out mechanism 43 includes conveying mechanisms such as endless conveyor belts 43*a* to 43*d* disposed under the lower open ends 42*a* to 42*d* of the bill packet accommodating sections 40*a* to 40*d*. A chute 45 is disposed along the opposite side of the bill packet accommodating sections. It is inclined from the front end of the front side bill packet accommodating sections toward the elevator mechanism 46. The endless conveyor belts 43*a* to 43*d* are provided with respective rows of protuberances 44*a* to 44*d*. The protuberances in the row are arranged side by side in the direction of the belt run such that they can be in contact with the band of the lowermost bill packet in the stack. The protuberances are provided on more than one half the length of the conveyor belt and are not provided on the other portion of the belt. The length of the belt portion that is free from the protuberance row is greater than the short side dimension of the bill packet. Thus, an apparent recess in which a bill packet can be received is provided in the conveyor belt. When the row of protuberances is found under the lowermost bill packet in the stack, a gap less than the thickness of one bill packet is formed between the top of the slit of the bill packet accommodating section and the top of the protuberance row. When a bill packet discharging command for discharging, for instance, a bill packet in the bill packet accommodating section 40*a* is given from the operating section 5, the conveyor belt 43*a* is driven in the direction of arrow B in FIG. 3. As a result, the lowermost bill packet that has rested on the row of protuberances 42*a* and has been restricted against movement through the slit 40*a* falls onto the belt portion free from the protuberance row. The band of the lowermost bill packet is thus pushed by the leading one of the protuberances 44*a*. Thus, the lowermost bill packet is forced out through the slit 42*a* while its opposite ends are guided by the end supporting members 40*e*, so that it is transferred onto the chute 45 and conveyed on the shoot toward the elevator mechanism 46 (i.e., in the direction of arrow C in FIG. 4). In the above way, bill packets stacked in each of the bill packet accommodating sections 40*a* to 40*d* can be fed out one by one from the lowermost bill packet. Since the opposite ends of the bill packet are supported by the end supporting members 40*e* as it is taken out, there is no possibility of the bill packet getting loose with breakage of the band. The elevator mechanism 46 is provided in the deepest part of the apparatus 2. It includes a vertical endless chain 50, which is passed around an upper driven sprocket wheel 49 and a lower drive sprocket wheel 48. A vertical guide 53 extends along the chain 50. A bill packet stay 47 is rotatably mounted at one end on a pin 51 of the chain 50. It carries a roller provided at the end opposite the pin 51. It can be vertically moved with the roller 52 in rolling contact with the guide 53. In the lower set position of the bill packet stay 47, its free end is found in the vicinity of the free end of the shoot 45. The guide 53 has an upper inclined end portion inclined toward the driven sprocket wheel 49. The drive sprocket wheel 48 is driven from a reversible motor (not shown) to move the bill stay 47. The bill stay 47 can be moved with the chain 50 either upwards or downwards (i.e., in either direction of arrow D1 or D2 in FIG. 4) while it is held in a substantially horizontal posture by the engagement between the guide 53 and roller 52. When the stay 47 reaches the upper inclined end portion of the guide 53, it is turned about the pin 51 to maintain the contact between the roller 52 and guide 53. Thus, the stay 47 is tilted downward toward the front as shown by the broken lines in FIG. 4. With the tilting of the stay, the bill packet slips off the stay 47. A bill packet discharging conveyor 54 passed round two rollers 55 and 56 is disposed to receive a bill packet slipping off the bill packet stay 47 that is, it is disposed at a sufficiently low level to receive the bill packet. The bill packet transferred to the bill packet discharging conveyor 54 is led to the bill packet discharging outlet 2A provided at the front top of the apparatus 2. The conveyor 54 is driven according to a control signal from the operating section 5. After the discharging is completed, the bill packet stay 47 is brought back to the initial lower set position.

Figure 5:
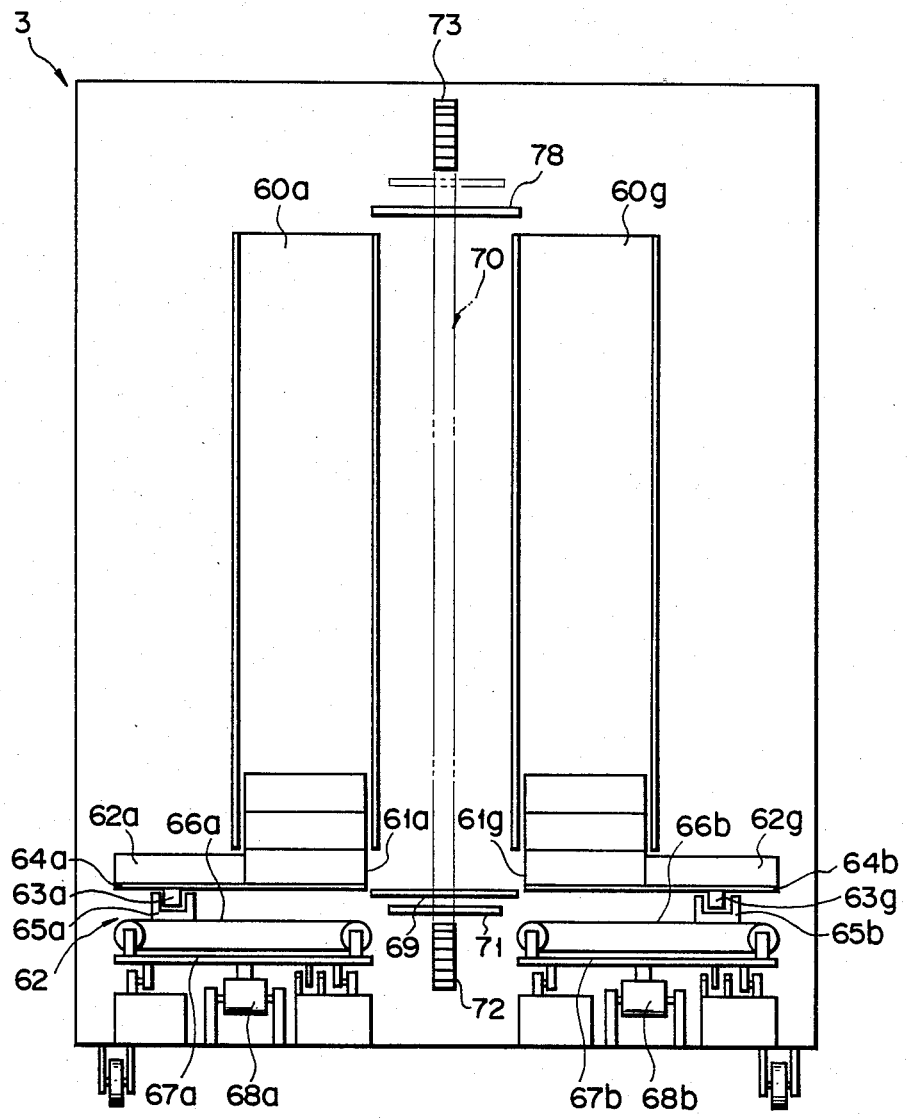
FIG. 5 is a front view showing the internal construction of a coin roll discharging apparatus.
Figure 6:
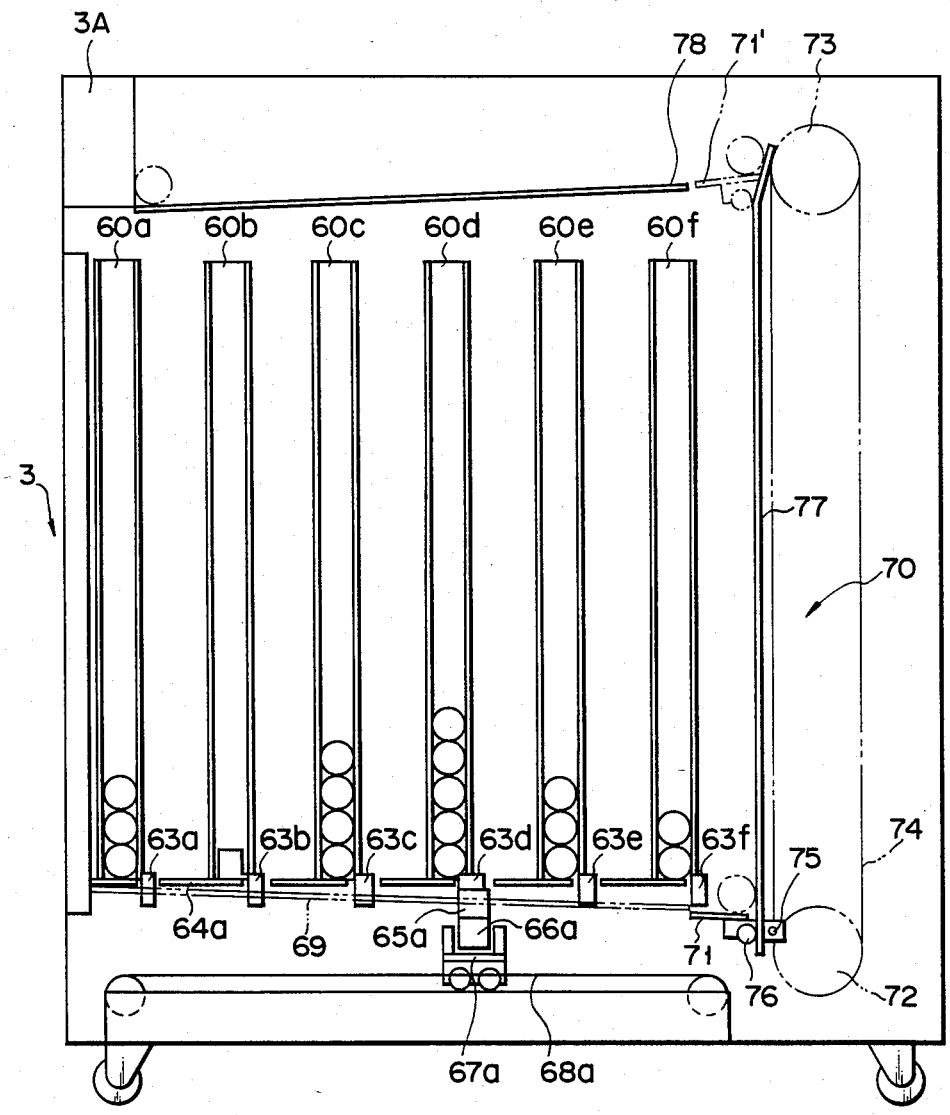
FIG. 6 is a side view showing the internal construction of the coin roll discharging apparatus shown in FIG. 5.

The coin roll discharging apparatus 3 has a construction as shown in front view in FIG. 5 and in side view in FIG. 6. The coin roll discharging apparatus 3 includes a plurality of coin roll accommodating sections 60*a* to 60*g*. Coin rolls of different denominations are accommodated in stacks in these coin roll accommodating sections 60*a* to 60*g*. The coin rolls are stacked in the lateral direction. Coin rolls in the individual coin roll accommodating sections can be taken out by a coin roll take-out mechanism 62. An elevator mechanism 70 is provided to upwardly convey each taken-out coin roll. A coin roll discharging shoot 78 is provided to receive the upwardly conveyed coin roll and lead it to the coin roll discharging outlet 3A provided at the top front of the apparatus 3. Each coin roll includes a plurality of (for instance, fifth) coins stacked side by side. The direction of stack is the longitudinal direction of the coin roll, and the opposite ends thereof correspond to coin surfaces. The coin roll accommodating sections are arranged in two rows of sections 6*a* to 6*f* and 6*g*, . . . which extend from the front of the apparatus so that the longitudinal direction of the coin rolls is parallel with the plane of the front. The two coin roll rows are spaced apart by a certain distance.

Horizontal plates 64*a*, 64*b* are disposed beneath the individual coin roll accommodating sections 60*a* to 60*g*. A gap slightly greater than the height, i.e., transversal dimension, of one coin roll is defined between the lower end of each of the coin roll accommodating sections 60*a* to 60*g* and each of the horizontal plates 64*a*, 64*b*. The horizontal plates 64*a* and 64*b* are provided for the respective coin roll accommodating section rows and are disposed symmetrically when viewed from the front of the apparatus 3. The lowermost coin roll in each stack is horizontally movable in its longitudinal direction through each of the gaps 61*a* to 61*g* defined under the coin roll accommodating sections 60*a* to 60*g*. The coin roll take-out mechanism 62 is provided to sandwich the coin roll accommodating sections when viewed from the front of the apparatus. The mechanism 62 includes coin roll pushing rods 62*a* to 62*g*, each of which is disposed below each coin roll accommodating section and is movable in the longitudinal direction. Protuberances 63*a* to 63*g* are disposed on the bottom of the respective coin roll pushing rods 62*a* to 62*g* and engaged with the recesses of a pair of protuberance engaging members 65*a* and 65*b* which are secured to respective driving belts 66*a* and 66*b*. The protuberance engaging members 65*a* and 65*b* are adapted to selectively engage the protuberances 62*a* to 62*g* and can be moved by the driving belts in the longitudinal directions of the stacked coin rolls.

The driving belts 66*a* and 66*b* are driven by belt drivers 67*a* and 67*b*. The driving belts 66*a* and 66*b* can be moved in the directions at right angles to the direction of the stacked coin rolls to a position below a selected denomination coin roll accommodating section by denomination selecting belts 68*a* and 68*b*. The protuberances 63*a* to 63*g* of the coin roll pushing rods 62*a* to 62*g* penetrate slots (not shown) formed in the respective horizontal plates 64*a* and 64*b* and project downward from the same. Each of these protuberances can be moved along each of these slots in the longitudinal direction of the stacked coin rolls. With this movement, the associated coin roll pushing rod is also moved to push out a corresponding coin roll. Each of the protuberance engaging members 65*a* and 65*b* receives a selected one of the protuberances 63*a* to 63*b* and in its recess and move with it. The driving belts 66*a* and 66*b* are driven by the denomination selecting belts 68*a* and 68*b* to select a specified denomination.

For example, when the coin roll accommodating section 60*d* is selected according to a coin roll discharging command from the operating section 5, the denomination selecting belts 68*a* and 68*b* are driven to bring the protuberance engaging member 65*a* to the position of the protuberance 63*d* for the selected coin roll accommodating section 69*d*. Subsequently, the driving belt 66*a* is driven to advance the protuberance 63*d*, and hence the coin roll pushing rod 62*d*, thus pushing out the specified coin roll. After completion of the pushing-out, the driving belt and denomination selecting belts are brought back to their initial set positions. Between and along the opposite side coin roll accommodating section rows, a shoot 69 is disposed such that it is inclined downward from front side of the apparatus 3 toward an elevator mechanism 70, which is disposed in the deepest portion of the apparatus 3. The pushed-out coin roll is allowed to roll over the shoot 69 to be transferred to the elevator mechanism 70. In the present embodiment, the coin roll pushing rods are provided for each of the coin roll accommodating sections to provide for high freedom in the operation of pushing out a coin roll of a selected domination. Alternatively, a single coin roll pushing rod may be coupled to each protuberance engaging member, or assemblies each including a coin roll pushing rod, a protuberance engaging member and a driving belt, may be provided in number corresponding to the number of coin roll accommodating sections.

The elevator 70 has substantially the same construction as the elevator mechanism 46 provided in the bill discharging apparatus. As mentioned earlier, it is provided in the deepest portion of the apparatus 3 and includes a vertical endless chain 74 passed around an upper driving sprocket wheel 73 and a lower driving sprocket wheel 7, a guide 77 extending along the chain 7 and having an inclined upper end portion, and a coin roll stay 71 pivotally mounted at one end on a pin 75 of the chain 74 and carrying a rotatable roller 76 in rolling contact with the guide 77. The coin roll stay 71 is driven together with the chain 74 from a reversible motor (not shown) via the driving sprocket wheel 72. While the stay 71 is moved in a vertical direction, it is held in a substantially horizontal posture by the engagement between the roller 76 and guide 77. When the stay 71 reaches the inclined upper end portion of the guide 77, it is turned about the pin 75 of the chain 74 to maintain the contact between the roller 76 and guide 77. Thus, it is tilted to a downwardly inclined state toward the front of the apparatus (as shown by broken lines 71' in FIG. 6). With the tilting of the coin roll stay 71, the coin roll having been conveyed is allowed to fall off the stay. The coin roll falls onto a coin roll discharging shoot 78, which is inclined downwards toward the coin roll discharging outlet 3A. Thus, the coin roll can roll down over the shoot 8 to be led to the discharging outlet 3A. After completion of the discharging, the coin roll stay 71 in the elevator mechanism 70 is brought back to the initial set position. If a command to select two or more coin rolls or select coin rolls of two or more different denominations is given, the elevator mechanism 70 is caused to repeatedly execute vertical excursions to discharge the specified amount of coin rolls.

Figure 7:
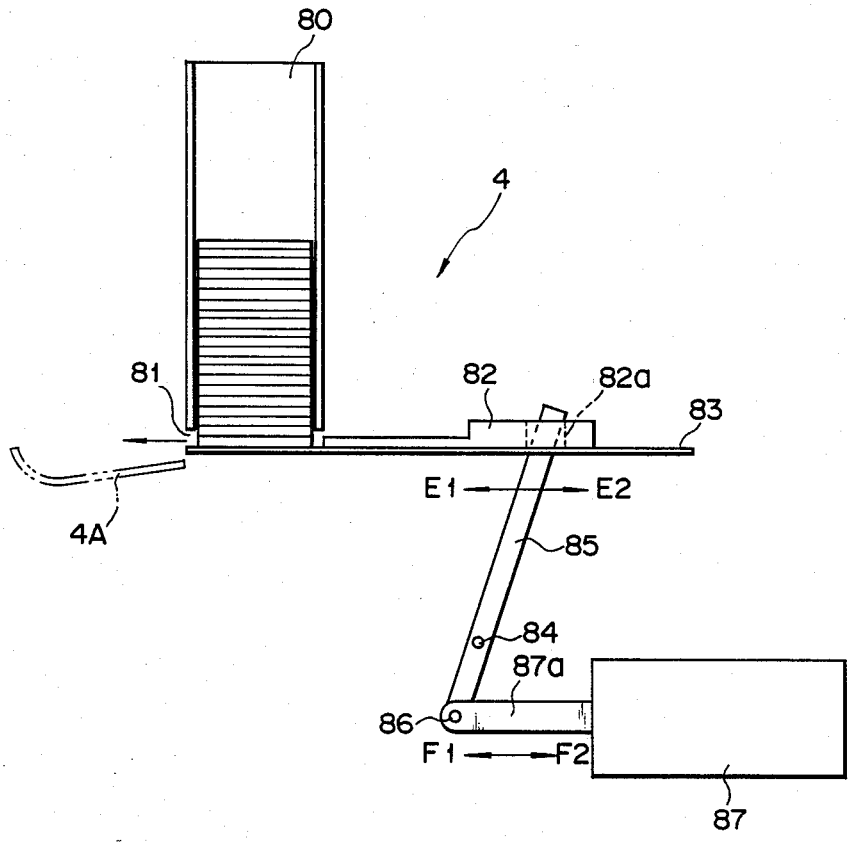
FIG. 7 is a schematic view showing a coin discharging device.

The coin discharging apparatus 4 has a construction as shown in the schematic view of FIG. 7. The apparatus 4 includes a coin accommodating section 80 accommodating coins stacked one above another. (Actually, the apparatus includes a plurality of coin accommodating sections respectively accommodating coins of different denominations.) A horizontal plate 81 is disposed below the coin accommodating section 80 such that a gap wider than the thickness of one coin but narrower than the thickness of two coins is defined between the section 80 and plate 81. The saucer 4A is disposed ahead of and below the front end of the horizontal plate 83. A coin pushing member 82 is provided on a rearwardly extending portion of the horizontal plate 83. The member 82 can be moved relative to the horizontal plate 83 in the directions of arrows E1 and E2. The coin pushing member 82 has a forward portion having a thickness smaller than the height of a coin discharging outlet 81 provided in the coin accommodating section 80. Thus, when the member is displaced forwards (i.e., in the direction of arrow 1l), it can push out one coin without fail. The member 82 has a stem portion formed with a hole 82*a*. A lever 85, which can execute a pendulum motion about a pin 84, loosely penetrates the hole 82*a*. The coin pushing member 82 can thus be moved back and forth with the pendulum portion of the lever 85. The lever 85 is pivotally coupled at the other end by a pin 86 to the free end of a rod 87*a* of a solenoid unit 87. The solenoid unit 87 can be driven for a required number of reciprocations (in the directions of arrows F1 and F2) according to a control signal from the operating section 5.

Figure 8:
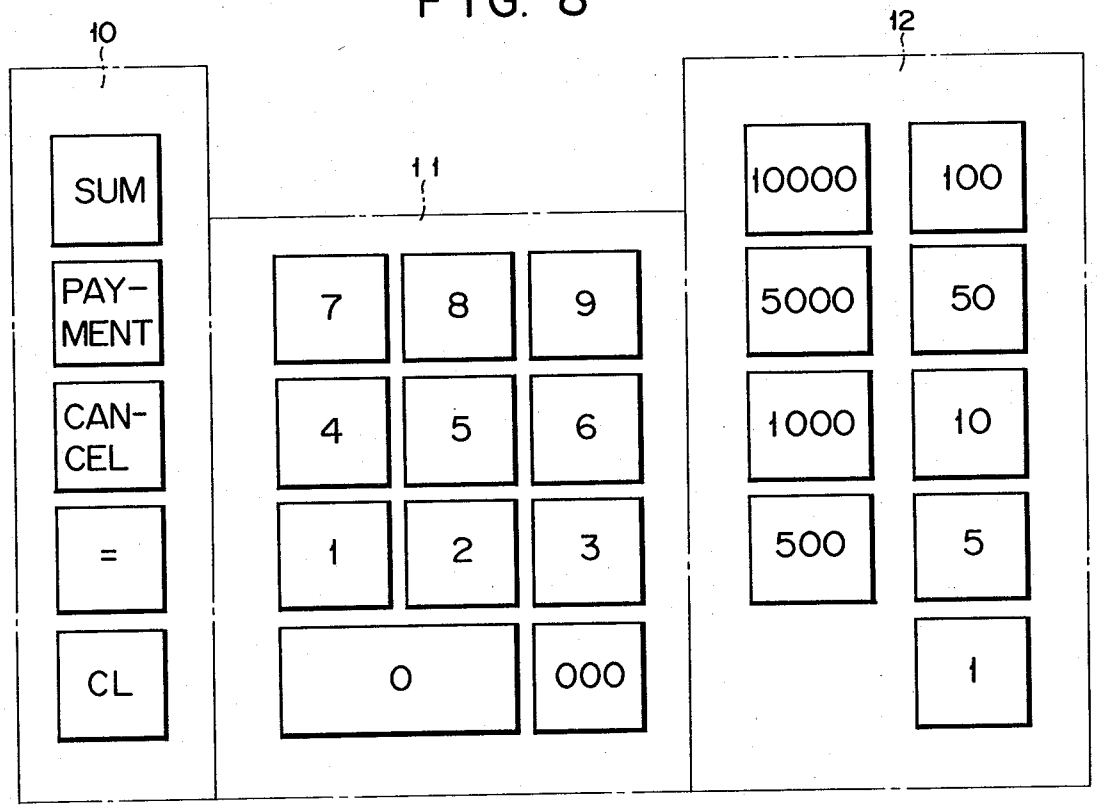
FIG. 8 is a plan view showing an operation key panel shown in FIG. 1.

A specific construction of the operating section 5 will now be described. As shown in FIG. 8, the operation panel 9 of the operating section 5 is provided with the group 10 of command keys, namely, "sum total", "payment", "cancellation", "=" and "CL" keys, group 11 of numeral keys, namely numeral "0" to "9" and "000" keys, and group 12 of domination specifying keys, namely "10,000 yen", "5,000 yen" and so forth.

Figure 9:
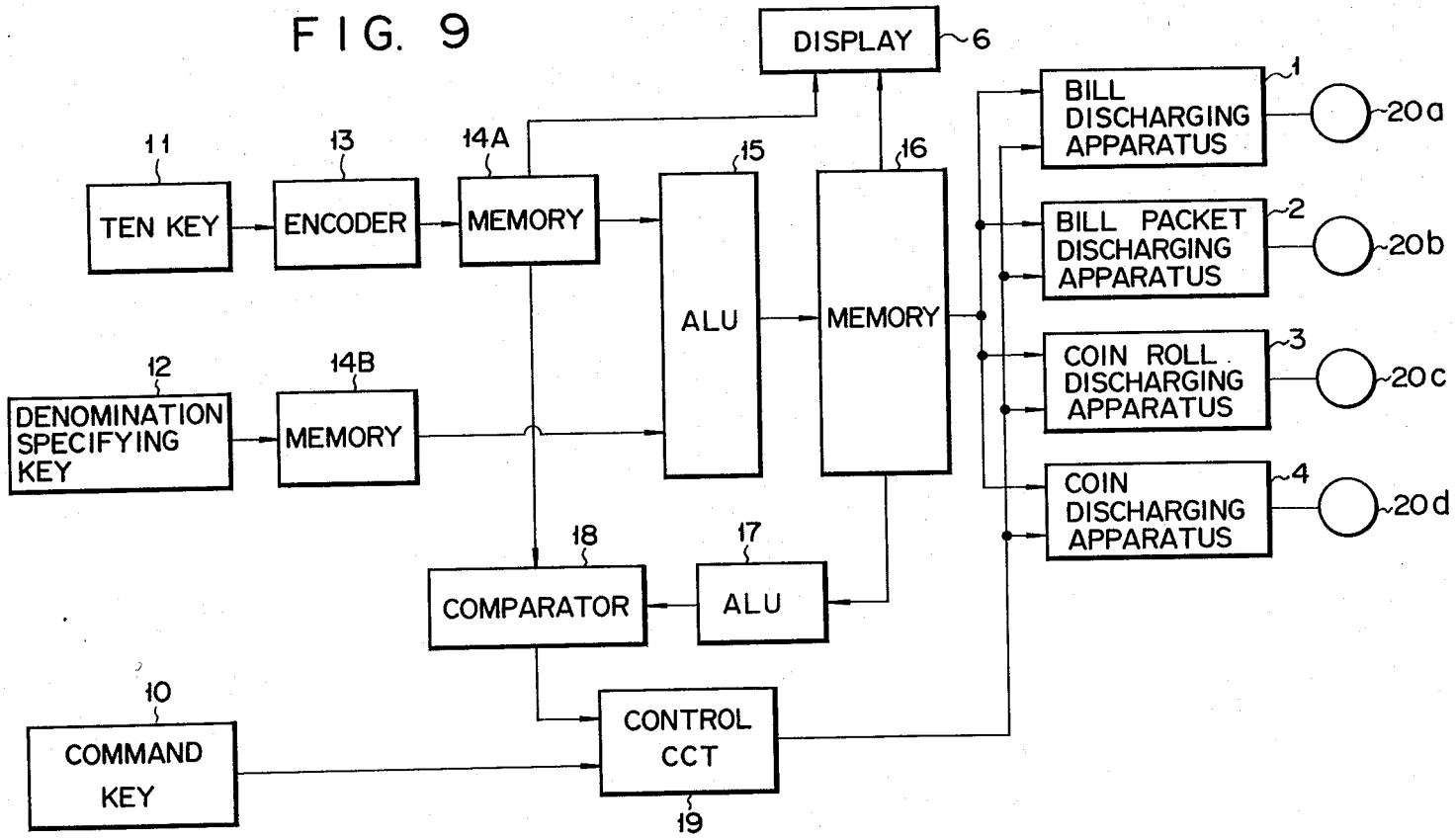
FIG. 9 is a block diagram showing the electric circuitry of the automatic money discharging system shown in FIG. 1.

FIG. 9 shows an example of the control section of the operating section 5. Numeral data coupled from the numeral key group 11 are fed to an encoder 13, which converts the input data into binary data of 4 bits for each digit. The output of the encoder 13 is successively stored in a memory 14A. Data from the denomination specifying key group 12 is stored in a memory 14B. A calculating circuit 15 calculates the amounts of money to be discharged in respective dominations from the data stored in the memories 14A and 14B. A memory 16 stores the results of calculations performed in the calculating circuit 15. A calculating circuit 17 calculates amounts afresh from the data stored in the memory 16. A comparator 17 compares the amount calculated by the calculating circuit 17 and the amount specified in the numeral key group, i.e., the data stored in the memory 14A, and produces a coincidence signal if the compared data coincide. A control circuit 19 produces a control signal if it receives the coincidence signal output from the comparator 18 and a discharging command from the command key group 10 (for instance the output from the "=" or "payment" key). The output of the memory 16 is fed to the individual discharging apparatuses 1 to 4. The discharging apparatuses 1 to 4 are driven according to this output and also the output from the control circuit 19. The discharging indication lamps 20*a* to 20*d* are on-off controlled according to control signals from the discharging apparatuses 1 to 4. Whether or not money has been discharged can be known by light from these lamps. The data sorted in the memories 14A and 16 are displayed in the display section 6.

Figure 10:
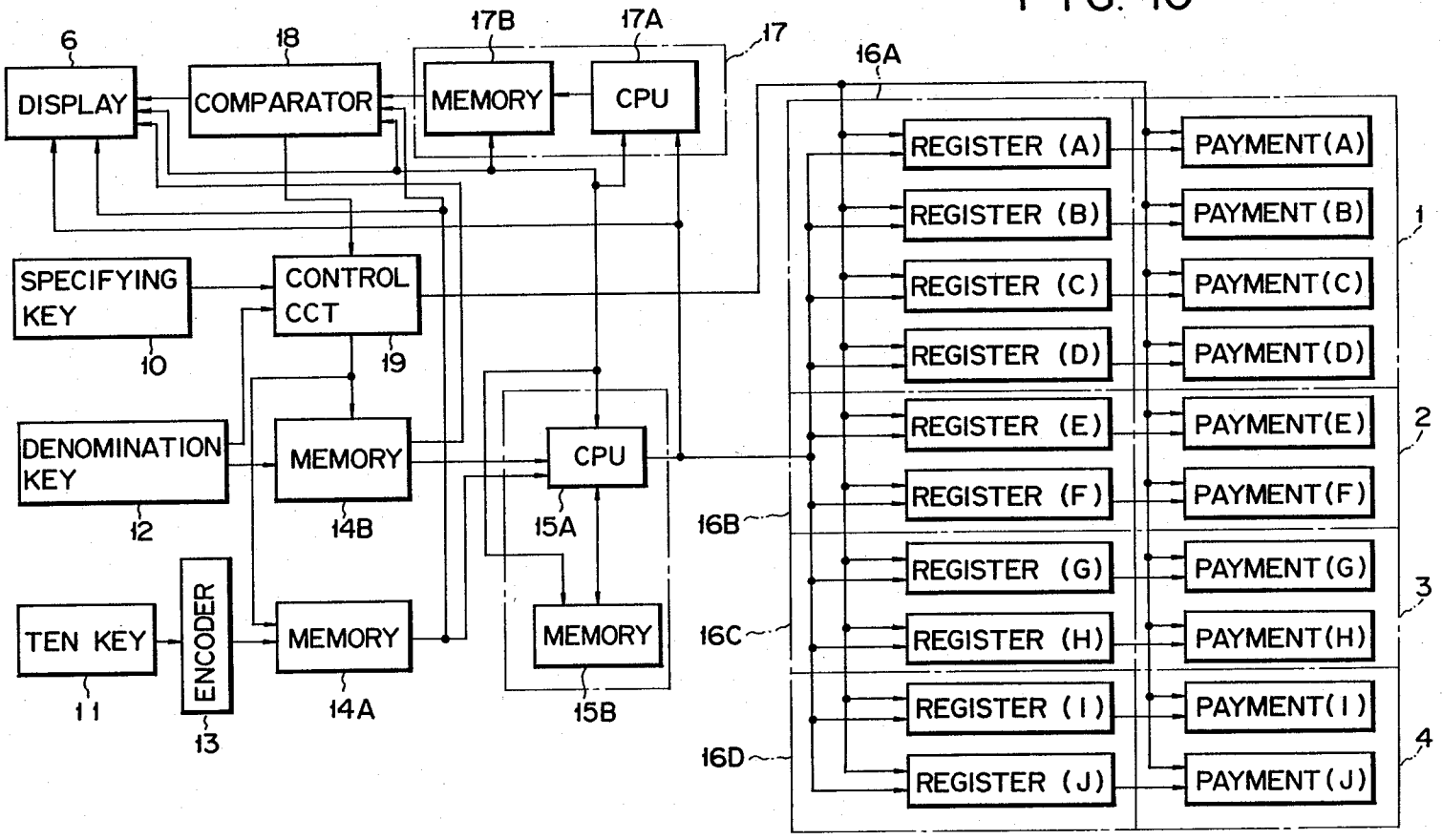
FIG. 10 is a block diagram showing a specific example of the circuit of FIG. 9.

FIG. 10 shows a specific detailed circuit construction of the control section. The same blocks as those in FIG. 9 are designated by like reference numerals or symbols. As shown in FIG. 10, the calculating circuit 15 includes a calculator 15A and a balance memory 15B. The memory 16 includes a register block 16A having registers A to D for the respective discharging apparatuses A to D, a register block 16B having registers E and F, a register block 16C having registers G and H and a register block 16D having registers I and J. The individual registers A to J are connected to respective payment (or discharging) control circuits A to J. The calculating circuit 17 includes a calculator 17A and a memory 17B.

Figure 11:
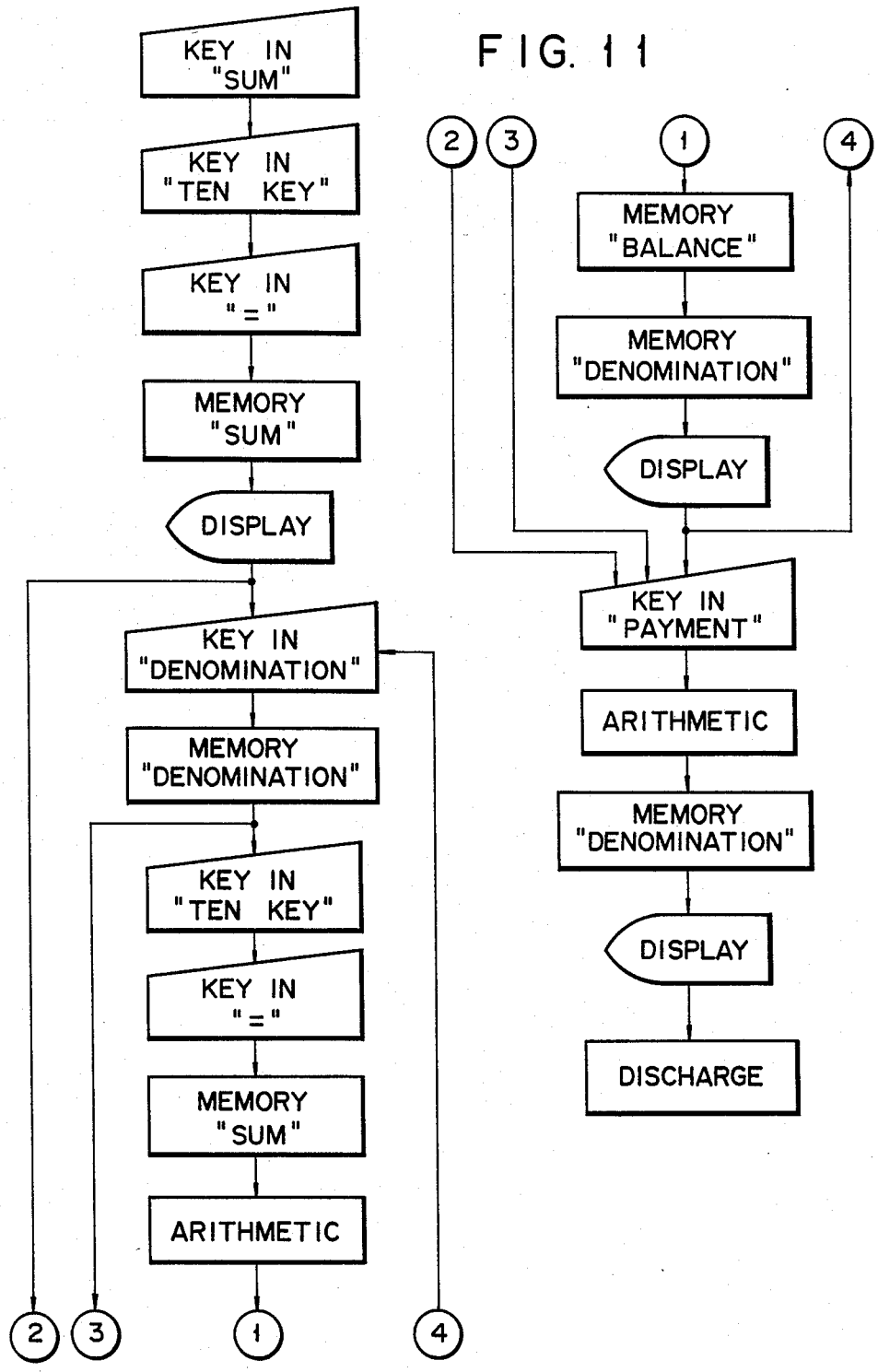
FIG. 11 is a flow chart illustrating the operation of the automatic money discharging apparatus of FIG. 1.

The operation of the automatic money discharging system will now be described with reference to the flow chart of FIG. 11.

First, the "sum total" key in the command key group 10 is depressed for specifying the sum total to be discharged. Then, the sum is entered by operating the numeral key group 11. The numeral entered from the numeral key group 11 is converted by the encoder 13 into 4-bit binary data for each input numeral digit. This data is successively stored in the memory 14A until the "=" key in the command key group 10 is depressed. The signal produced when the "sum total" key is depressed is fed to the control circuit 19. According to this signal, the control circuit 19 supplies a control signal to the memory 14A so that the sum total data entered is stored in a predetermined area of the memory 14A. This stored data is displayed on the display section 6.

When it is desired to obtain payment of the sum total in the highest denomination, i.e., in the least number of bills and coins, the "payment" key in the command key group 10 may be depressed at this time. As a result, a payment command is coupled through the control circuit 19 to the memories 14A and 14B and also to the balance memory 15B. At this time, checking as to whether or not there is any specification of denomination and also checking as to whether or not there is any balance is performed. In the present instant case there is neither specification of denomination nor balance. Thus, the calculator 15A is rendered operative by a control signal from the control circuit 19, so that the numbers of bill packets, bills, coin rolls and coins (one bill packet being registered as such when 100 bills are counted and one coin roll registered as such when 50 coins are counted) necessary for the payment of the sum total stored in the memory 14A on the highest denomination basis are calculated. The results of this calculation are calculated back to the corresponding amount, which is stored in the memory 17B. At this time, the comparator 18 is rendered operative to compare the data stored in the memory 17B and the data (i.e., sum total) stored in the memory 14A. If the two data compared coincide, a coincidence signal is supplied to the control circuit 19. In response to the coincidence signal, the control circuit 19 causes the results of the calculation in the calculator 15A to be stored in pertaining registers A to J in the memory 16. Subsequently, the relevant payment control circuits A to J in the discharging apparatus 1 to 4 are driven to effect payment (i.e., discharging) of money according to the data stored in the pertaining registers.

In a case where specification of denomination is made by operating the denomination specifying key group 12 after entering the sum total with the numeral key group 11 and before the operation of the "payment" key, denomination specification data stored in the memory 14B is checked according to a control signal from the control circuit 19. In this case, the calculator 15A calculates the numbers of bill packets, bills, coin rolls and coins necessary for payment according to the sum data stored in the amount memory 14A and the denomination data stored in the denomination memory 14B.

A case in which it is desired to get payment in specific denomination for part of the sum total and on the highest denomination basis for the balance, will now be described. In this case, the "sum total" key in the command key group 10 is first depressed, and then the sum total is entered by operating the numeral key group 11. The specified sum total data is coupled through the encoder 13 to the amount memory 14A to be stored in the same manner as described before. Thereafter, the specification of denomination is done by operating the denomination specifying key group 12. The denomination specification data thus produced is stored in the denomination memory 14B. At the same time, a signal representing a mode in which denomination is specified is supplied to the control circuit 19. Thus, the sum total of money to be paid in the specified denomination (hereinafter referred to as specified denomination amount) is stored in the amount memory 14A in a predetermined area thereof. Then, a control signal from the control circuit 19 causes the calculator 15A to calculate the numbers of bill packets, bills, coin rolls and coins to be paid (discharged) from the data stored in the amount memory 14A and in the denomination memory 14B. At this time, the numbers of bill packets and coin rolls and the numbers of bills and coins are calculated separately. The results of this calculation are fed to the calculator 17A which calculates the amount again from the input data. The amount data of the calculator 17A is stored in the memory 17B. The output of the memory 17B is supplied to the comparator 18. If a coincidence signal is provided from the comparator 18, the control circuit 19 controls the pertaining registers A to J in the memory 16 to store the results of calculation in the calculator 15A in these registers. The calculator 15A is also caused to subtract the specified denomination amount from the sum total data stored in the amount memory 14A. The balance data thus obtained is stored in the balance memory 15B.

If it is desired to obtain payment of part of the sum total of money in a different denomination, the desired specified denomination amount data and denomination data are similarly coupled. These data are again stored in the respective memories 14A and 14B. The calculator 15A is again caused to calculate the numbers of bill packet, bills, coin rolls and coins from the newly stored data. The results of calculation are again stored in the pertaining registers. In the amount memory 14A, the previous specified denomination amount data is renewed, and the new specified denomination amount data is stored. Also, the new specified denomination amount stored in the amount memory 14 is subtracted from the previous balance data stored in the balance memory 15B. The result of subtraction, i.e., the new balance data, is stored in the balance memory 15B. Further, the memory 17B has a memory area, in which the new calculation result data from the calculator 17A is stored, and a memory area, in which the sum of the previous calculation result data and the new calculation result data is stored. The data in these memory areas are renewed each time new data is coupled.

When the "payment" key in the command key group 10 is depressed after completion of entry of the denomination data and specified denomination amount data, the calculator 15A is caused to calculate this time the number of bill packets, bills, coin rolls and coins, for instance the number of 5,000-yen bills and 1,000-yen bills, necessary to pay the last balance stored in the balance memory 15B. The results of calculation are again fed to the calculator 17A and calculated back to the amount again. The amount data is added to the previous sum data stored in the memory 17B. The new sum data is stored in the memory area, in which the previous sum data has been stored. The new sum data stored in the memory 17B is supplied to the comparator 18. At this time, a signal based on the depression of the "payment" key is supplied from the control circuit 19 to the amount memory 14A. As a result, the sum total data stored in the amount memory 14A is read out and supplied to the comparator 18. If the comparator 18 provides a coincidence signal at this time, the results of calculation in the calculator 15A are stored in pertaining registers according to a signal from the control circuit 19. Subsequently, relevant payment control circuits A to J in the discharging apparatuses 1 to 4 are driven to effect payment (i.e., discharging) of the given amount of money.

The operation that takes place when a non-coincidence signal is produced from the comparator 18 will now be described. When a non-coincidence signal is produced after completion of the specification of denomination and specified denomination amount, the results of calculation in the calculator 15A are cleared. Then, the data stored in the amount memory 14A and data stored in the denomination memory 14B are read out again and supplied to the calculator 15A for new calculation. The results are supplied to the comparator 18. This sequence of operation is repeated until the comparator produces a coincidence signal. If a non-coincidence signal is produced after the depression of the "payment" key in the command key group 10 (i.e., in case of non-coincidence with the sum total), the non-coincidence is displayed on the display section 6. The operator thus depresses the "CL" key and then the "sum total" key in the command key group 10, whereby a new calculation is executed.

The data of the sum total and amounts and numbers of bill packets, bills, coin rolls and coins that are displayed on the display section 6 are renewed according to a control signal from the control circuit 19 each time the memories 14A and 14B and calculator 15A are rendered operative or a coincidence signal is provided from the comparator 18.

An example of bringing about payment (i.e., discharging) of part of the sum total of money in specific denomination and the balance on the highest denomination basis will now be described.

A case in which it is desired to obtain a sum total of 18,500 yen, specifically in 100-yen coins for 6,000 yen, 10-yen coins for 500 yen and on the highest denomination basis for the rest is given. First, the "sum total" key in the command key group 10 is depressed, and then keys in the numeral key group 11 are depressed for coupling successive numerals "1", "8", "5", "0" and "0" in that order. Then, the "=" key in the command key group 10 is depressed. As a result, the sum total of 18,500 yen is stored as binary data of 4 bits for each digit in the predetermined memory area of the amount memory 14A according to a control signal from the control circuit 19. Subsequently, the "100 yen" key, for instance, in the denomination specifying key group 12 is depressed, and "6" and "000" keys in the numeral key group 11 are depressed in that order. Subsequently, the "=" key in the command key group 10 is depressed. As a result, data representing 6,000 yen is stored in a predetermined memory area of the amount memory 14A, while data representing 100 yen is stored in the denomination memory 14B. The control circuit 19 then checks that these data are stored in the memories 14A and 14B and transfers these data to the calculator 15A. The calculator 15A is caused to execute calculations on the data of 6,000 yen and 100-yen coins. Since one coin roll includes 50 coins, the calculator 15A yields result data representing one 100-yen coin roll and ten 100-yen coins. The results are fed to the calculator 17A for calculation back to the amount. The data of the calculator 17A is stored in the memory 17B and supplied to the comparator 18 for comparison with the specified denomination amount data in the amount memory 14A. When a coincidence signal is produced from the comparator 18, the control circuit 19 causes the results of calculation in the calculator 51A to be transferred to and stored in pertinent registers. That is, data "1" is stored in the 100-yen coin roll register G for the coin roll discharging apparatus 3, and data "10" in the 10-yen coin register I for the coin discharging apparatus 4. The control circuit 19 also causes the calculator 15A to subtract the specified denomination amount (6,000 yen) from the total amount (18,500 yen) stored in the amount memory 14A. The difference (12,500 yen) is stored in the balance memory 15B. Subsequently, keys in the numeral key group 11 are depressed for coupling successive numerals "5", "0" and "0" in the mentioned order, and then the "=" key in the command key group 10 is depressed. As a result, the new specified denomination amount data (500 yen) is stored in the memory area of the amount memory 14A, in which the previous specified denomination amount data (6,000 yen) has been stored, while the denomination data of 100-yen coins is additionally stored in the denomination memory 14B. As a result, a calculation similar to the previous calculation with respect to the 100-yen coins, is executed. The results of this calculation are checked by the comparator 18. Thus, data "1" is stored in the register H for the coin discharging apparatus 3. At the same time, data (12,000 yen) obtained as a result of subtraction of the new specified denomination amount data (500 yen) from the previous balance data (12,500 yen) is stored in the balance memory 15B.

Afterwards, the "payment" key in the command key group 10 is depressed. As a result, the control circuit 19 checks if any further denomination specification data is stored in the denomination memory 14B and causes the calculator 15A to execute calculations on the data (12,000 yen) stored in the balance memory on the highest denomination basis. First, 10,000 yen units are subtracted from 12,000 yen. In some cases, 5,000-yen units, the next highest denomination are subtracted from 12,000 yen. In this case, since the 10,000-yen denomination specification data is not stored in the denomination memory 14B, 10,000-yen units are subtracted from 12,000 yen. As a result, the output data "1" is obtained with respect to the 10,000-yen denomination. Next, 5,000-yen units are subtracted from the balance of 2,000 yen. At this time, the output data with respect to the 5,000-yen denomination is "0". Then, 1,000-yen units, the third highest denomination, are subtracted from 2,000 yen. The output data with respect to the 1,000-yen denomination is "2". Since the 1,000-yen denomination specification data is not stored in the denomination memory 14B, this data is also made effective. The results of calculation on the balance, i.e., the data stored in the memory 15B, are thus obtained from the calculator 17A. The result data is added to the payment amount data of 6,500 yen for payment in 100-yen and 10-yen coins, stored in the memory 17B. That is, an amount corresponding to the keyed-in sum total 18,500 yen is calculated. This amount data and the sum total data stored in the amount memory 14A are compared in the comparator 18. When a coincidence signal is produced from the comparator 18, the control circuit 19 causes the result data of the calculator 15A to be stored in pertinent registers, such as data "1" in the register A for the bill discharging apparatus 1 and data "2" in the register C. According to these data, the pertinent payment control circuits A to J are controlled to effect discharging. In the present example, one 10,000-yen bill represented by the data "1" in the register A, two 1,000-yen bills represented by the data "2" in the register C, one 100-yen coin roll represented by the data "1" in the register G, one 10-yen coin roll represented by the data "1" in the register H and ten 100-yen coins represented by the data "10" in the register I are discharged. On the display section 6, data representing 18,500 yen, data representing 10,000 yen in one bill of the 10,000-yen denomination, data of 2,000 yen in two bills of the 1,000-yen denomination, data representing 6,000 yen in one coin roll and 10 bills of the 100-yen denomination and data representing 500 yen in one coin roll of the 10-yen denomination are displayed.

The above embodiment has been given for the purpose of illustration only, and various changes and modifications can be made without departing from the scope of the invention.

For example, the conveyor belts 43*a* to 43*d* provided with respective protuberance rows 44*a* to 44*d* defining depressed portions or recesses to receive a bill packet are by no means limitative and may be replaced with soft conveyor belts, each of which has an adequate thickness and formed on the conveying side with a recess for receiving a bill packet. As a further alternative, bill packet pushing rods each having a bill packet receiving recess may be reciprocably provided.

As has been described in the foregoing, with the bill packet discharging apparatus according to the present invention, bill packets can be taken out one by one without the possibility of breaking the band of the bill packet. Thus, the efficiency and reliability of the operation of discharging bill packets can be improved.

What we claim is:

1. A sheet packet discharging apparatus comprising:

at least one packet accommodating case accommodating a stack of packets each bound by a band and having an outlet provided at one end;

a sheet packet transport path;

sheet packet feed-out means disposed below said sheet packet accommodating case for feeding out a sheet packet in the stack in a longitudinal direction of the band from said sheet packet accommodating case to the sheet packet transport path, said sheet packet feed-out means including conveyor means movable in the direction of feeding out the sheet packet, said conveyor means including a conveyor belt movable in the direction of feeding out the sheet packet, a first portion of said conveyor belt having a plurality of protuberances projecting in a row therefrom and a second portion of said conveyor belt being without said protuberances, said conveyor means cooperating with said outlet so that said protuberances maintain said packets in said packet accommodating case and said second portion allows one packet to be released from said packet accommodating case, said second portion having a length greater than that of the stack of sheet packets in the direction of the band, the leading part of said protuberances pushing said one packet in said second portion to said sheet packet transport path; and means provided on said sheet packet transport path for transporting and discharging a sheet packet fed out by said feed-out means on said transport path to a sheet packet discharging outlet.

2. The sheet packet discharging apparatus according to claim 1, which comprises a plurality of sheet packet accommodating cases respectively accommodating different kind sheet stacks, and in which said sheet packet feed-out means can feed out sheet packets of a specified denomination from the corresponding sheet packet accommodating case in a longitudinal direction of the band.

3. A sheet packet discharging apparatus comprising:

at least one packet accommodating case accommodating a stack of packets each bound by a band and having an outlet provided at one end;

a sheet packet transport path;

sheet packet feed-out means disposed below said sheet packet accommodating case for feeding out a sheet packet in the stack in a longitudinal direction of the band from said sheet packet accommodating case to the sheet packet transport path, said sheet packet feed-out means including conveyor means movable in the direction of feeding out the sheet packet, said conveyor means including a surface, a first portion having protuberance means projecting from said surface and a second portion without said protuberance means, said conveyor means cooperating with said outlet so that said protuberance means maintains said packets in said packet accommodating case and said second portion allows one packet to be released from said packet accommodating case, said second portion having a length greater than that of the stack of sheet packets in the direction of the band, the leading part of said protuberance means pushing said one packet in said second portion to said sheet packet transport path; and means provided on said sheet packet transport path for transporting and discharging a sheet packet fed out by said feed-out means on said transport path to a sheet packet discharging outlet, said sheet packet transporting/discharging means including elevator means for upwardly conveying the sheet packet fed out by said sheet packet feed-out means and means for leading the upwardly conveyed sheet packet to the sheet packet discharging outlet provided adjacent to the top of the apparatus.

4. The sheet packet discharging apparatus according to claim 3, wherein said elevator means includes a guide extending upright, a sheet packet stay, means for raising said stay along said guide with the sheet packet held thereon and means for downwardly tilting said stay at an upper portion of said guide to let the sheet packet slip off said packet stay.

5. The sheet packet discharging apparatus according to claim 1, 2 or 3, wherein said sheet packet accommodating case is provided with folded portions at both sides of one end to have both sides of said packet located on said folded portions, thereby enabling the folded portions to guide the discharge of the sheet.

* * * * *